US009641951B2

(12) United States Patent
Atkins et al.

(10) Patent No.: US 9,641,951 B2
(45) Date of Patent: May 2, 2017

(54) SYSTEM AND METHOD FOR FAST BINAURAL RENDERING OF COMPLEX ACOUSTIC SCENES

(75) Inventors: Joshua David Atkins, Baltimore, MD (US); James Edward West, Plainfield, NJ (US)

(73) Assignee: THE JOHNS HOPKINS UNIVERSITY, Baltimore, MD (US)

( * ) Notice: Subject to any disclaimer, the term of this patent is extended or adjusted under 35 U.S.C. 154(b) by 334 days.

(21) Appl. No.: 13/571,917

(22) Filed: Aug. 10, 2012

(65) Prior Publication Data

US 2013/0064375 A1 Mar. 14, 2013

Related U.S. Application Data

(60) Provisional application No. 61/521,780, filed on Aug. 10, 2011.

(51) Int. Cl.
*H04S 7/00* (2006.01)
*H04R 3/00* (2006.01)

(52) U.S. Cl.
CPC ..... *H04S 7/301* (2013.01); *H04S 7/304* (2013.01); *H04R 3/005* (2013.01); *H04R 2203/12* (2013.01); *H04S 2420/01* (2013.01)

(58) Field of Classification Search
USPC ..... 381/17, 1
See application file for complete search history.

(56) References Cited

U.S. PATENT DOCUMENTS

2002/0150257 A1* 10/2002 Wilcock ..... G11B 19/025 381/17
2004/0091119 A1* 5/2004 Duraiswami ..... H04S 1/002 381/26

(Continued)

FOREIGN PATENT DOCUMENTS

WO WO 2010/092524 A2 * 8/2010

OTHER PUBLICATIONS

Song et al., Using Beamforming and Binaural Synthesis for the Psychoacoustical Evaluation of target Sources in Noise, Nov. 18, 2007, Journal of Accoustical Society America 123 (2) http://www.kog.psychologie.tu-darmstadt.de/media/angewandtekognitionspsychologie/staff/ellermeier_1/paper/Song_Ell_Hald_JASA_2008.pdf.*

(Continued)

*Primary Examiner* — Duc Nguyen
*Assistant Examiner* — Yogeshkumar Patel
(74) *Attorney, Agent, or Firm* — Johns Hopkins Technology Ventures

(57) ABSTRACT

An embodiment in accordance with the present invention provides a system and method for binaural rendering of complex acoustic scenes. The system includes a computing device configured to process a sound recording of the acoustic scene to produce a binaurally rendered scene for the listener. The system also includes a position sensor configured to collect motion and position data for a head of the user and also configured to transmit said motion and position data to the computing device. A sound delivery device is configured to receive the binaurally rendered acoustic scene from the computing device and to transmit the acoustic scene to the ears of the listener. In the system, the computing device is further configured to utilize the motion and position data from the inertial motion sensor to process the sound (Continued)

recording of the acoustic scene with respect to the motion and position of the user's head.

20 Claims, 10 Drawing Sheets

(56) References Cited

U.S. PATENT DOCUMENTS

2005/0100171 A1* 5/2005 Reilly ..... G10H 1/0091 381/63
2011/0293129 A1* 12/2011 Dillen ..... H04S 7/304 381/370

OTHER PUBLICATIONS

Song et al. "Using Beamforming and Binaural Synthesis for the Psychoacoustical Evaluation of Target Sources in Noise", J. Accoust. Soc. Am. 123 (2), Feb. 2008 http://www.kog.psychologie.tu-darmstadt.de/media/angewandtekognitionspsychologie/staff/ellermeier_1/paper/Song_Ell_Hald_JASA_2008.pdf.*
Song et al. "Using Beamforming and Binaural Synthesis for the Psychoacoustical Evaluation of Target Sources in Noise", J. Accoust. Soc. Am. 123 (2), Feb. 2008 http://www.kog.psychologie.tudarmstadt.de/media/angewandtekognitionspsychologie/staff/ellermeier_1/paper/Song_Ell_Hald_JASA_2008.pdf.*

* cited by examiner

SYSTEM AND METHOD FOR FAST BINAURAL RENDERING OF COMPLEX ACOUSTIC SCENES

CROSS REFERENCE TO RELATED APPLICATIONS

This application claims the benefit of U.S. Provisional Patent Application No. 61/521,780, filed on Aug. 10, 2011, which is incorporated by reference herein, in its entirety.

GOVERNMENT SUPPORT

This invention was made with government support under ID 0534221 awarded by the National Science Foundation. The government has certain rights in the invention.

FIELD OF THE INVENTION

The present invention relates generally to sound reproduction. More particularly, the present invention relates to a system and method for providing sound to a listener.

BACKGROUND OF THE INVENTION

Sound has long been reproduced for listeners using speakers and/or headphones. One method for providing sound to a listener is by binaurally rendering an acoustic scene. Binaural rendering allows for the creation of a three-dimensional stereo sound sensation of the listener actually being in the room with the original sound source.

Rendering binaural scenes is typically done by convolving the left and right ear head-related impulse responses (HRIRs) for a specific spatial direction with a source sound in that direction. For each sound source, a separate convolution operation is needed for both the left ear and the right ear. The output of all of the filtered sources is summed and presented to each ear, resulting in a system where the number of convolution operations grows linearly with the number of sound sources. Furthermore, the HRIR is conventionally measured on a spherical grid of points, so when the direction of the synthesized source is in-between these points a complicated interpolation is necessary.

Therefore, it would be advantageous to be able to provide rendering of binaural scenes using fewer convolution operations and without the complicated interpolation necessary for points in between the points on the spherical grid. It would also be advantageous to take into account a user's head rotation in reference to the simulated acoustic scene.

SUMMARY OF THE INVENTION

The foregoing needs are met, to a great extent, by the present invention, wherein in one aspect, a system for reproducing an acoustic scene for a listener includes a computing device configured to process a sound recording of the acoustic scene to produce a binaurally rendered acoustic scene for the listener. The system also includes a position sensor configured to collect motion and position data for a head of the user and also configured to transmit said motion and position data to the computing device, and a sound delivery device configured to receive the binaurally rendered acoustic scene from the computing device and configured to transmit the binaurally rendered acoustic scene to a left ear and a right ear of the listener. In the system the computing device is further configured to utilize the motion and position data from the inertial motion sensor in order to process the sound recording of the acoustic scene with respect to the motion and position of the user's head.

In accordance with another aspect of the present invention, the system can include a sound collection device configured to collect an entire acoustic field in a predetermined spatial subspace. The sound collection device can further include a sound collection device taking the form of at least one selected from the group consisting of a microphone array, pre-mixed content, or software synthesizer. The sound delivery device can take the form of one selected from the group consisting of headphones, earbuds, and speakers. Additionally, the position sensor can take the form of at least one of an accelerometer, gyroscope, three-axis compass, camera, and depth camera. The computing device can be programmed to project head related impulse responses (HRIRs) and the sound recording into the spherical harmonic subspace. The computing device can also be programmed to perform a psychoacoustic approximation, such that rendering of the acoustic scene is done directly from the spherical harmonic subspace. The computing device can be programmed to compute rotations of a sphere in the spherical harmonic subspace by generating a set of sample points on the sphere and calculating the Wigner-D rotation matrix via a method of projecting onto these sample points, rotating the points, and then projecting back to the spherical harmonics, and the computing device can also be programmed to calculate rotation of the sphere using quaternions.

In accordance with another aspect of the present invention, a method for reproducing an acoustic scene for a listener includes collecting sound data from a spherical microphone array and transmitting the sound data to a computing device configured to render the sound data binaurally. The method can also include collecting head position data related to a spatial orientation of the head of the listener and transmitting the head position data to the computing device. The computing device is used to perform an algorithm to render the sound data for an ear of the listener relative to the spatial orientation of the head of the listener. The method can also include transmitting the sound data from the computing device to a sound delivery device configured to deliver sound to the ear of the listener. The method can include the computing device executing the algorithm $$y(\omega) = \sum_{n=0}^{N} \sum_{m=-n}^{n} h_{mn}^{*}(\omega) p_{mn}(\omega) = h_{mn}^{H} p_{mn}.$$

The method can also include preprocessing the sound data, such as by interpolating an HRTF (head related transfer function) into an appropriate spherical sampling grid, separating the HRTF into a magnitude spectrum and a pure delay, and smoothing a magnitude of the HRTF in frequency. Collecting head position data can be done with at least one of accelerometer, gyroscope, three-axis compass, camera, and depth camera.

In accordance with yet another aspect of the present invention, a device for transmitting a binaurally rendered acoustic scene to a left ear and a right ear of a listener includes a sound delivery component for transmitting sound to the left ear and to the right ear of the listener and a position sensing device configured to collect motion and position data for a head of the user. The device for transmitting a binaurally rendered acoustic scene is further configured to transmit head position data to a computing device and wherein the device for transmitting a binaurally rendered acoustic scene is further configured to receive sound data for transmitting sound to the left ear and to the right ear of the listener from the computing device, wherein the sound data is rendered relative to the head position data.

In accordance with still another aspect of the present invention, the sound delivery component takes the form of at least one selected from the group consisting of headphones, earbuds, and speakers. The position sensing device can take the form of at least one of an accelerometer, gyroscope, three-axis compass, and depth camera. The computing device is programmed to project head related impulse responses (HRIRs) and the sound recording into the spherical harmonic subspace. The computing device is programmed to perform a psychoacoustic approximation, such that rendering of the acoustic scene is done directly from the spherical harmonic subspace. The computing device can also be programmed to compute rotations of a sphere in the spherical harmonic subspace by generating a set of sample point on the sphere and calculating the Wigner-D rotation matrix via a method of projecting onto these sample points, rotating the points, and then projecting back to the spherical harmonics.

BRIEF DESCRIPTION OF THE DRAWINGS

The accompanying drawings provide visual representations which will be used to more fully describe the representative embodiments disclosed herein and can be used by those skilled in the art to better understand them and their inherent advantages. In these drawings, like reference numerals identify corresponding elements and.

DETAILED DESCRIPTION

The presently disclosed subject matter now will be described more fully hereinafter with reference to the accompanying Drawings, in which some, but not all embodiments of the inventions are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

An embodiment in accordance with the present invention provides a system and method for binaural rendering of complex acoustic scenes. The system for reproducing an acoustic scene for a listener includes a computing device configured to process a sound recording of the acoustic scene to produce a binaurally rendered acoustic scene for the listener. The system also includes a position sensor configured to collect motion and position data for a head of the user and also configured to transmit said motion and position data to the computing device, and a sound delivery device configured to receive the binaurally rendered acoustic scene from the computing device and configured to transmit the binaurally rendered acoustic scene to aloft our and a right ear of the listener. In the system the computing device is further configured to utilize the motion and position data from the inertial motion sensor in order to process the sound recording of the acoustic scene with respect to the motion and position of the user's head.

Figure 1:
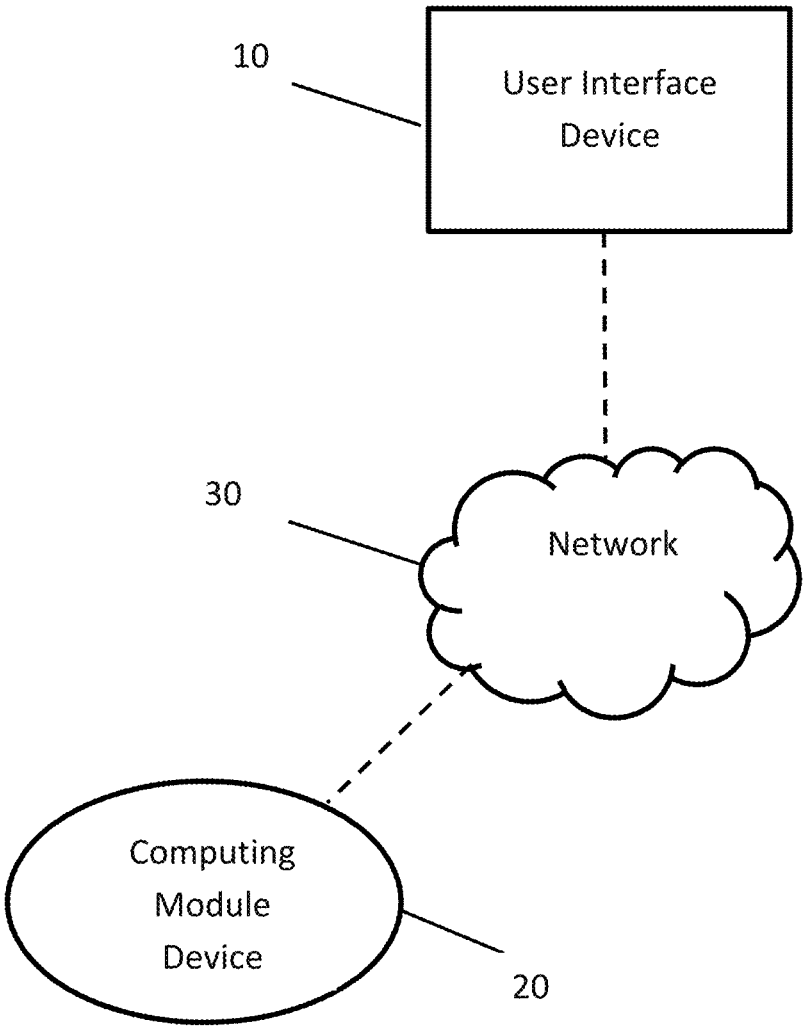
FIG. 1 illustrates a schematic diagram of a system for reproducing an acoustic scene for a listener in accordance with an embodiment of the present invention.

In one embodiment, illustrated in FIG. 1, the system for reproducing an acoustic scene for a listener can include a user interface device 10, and a computing module device 20. In some embodiments the system can include a position tracking device 25. The user interface device 10 can take the form of headphones, speakers, or any other sound reproduction device known to or conceivable by one of skill in the art. The computing module device 20 may be a general computing device, such as a personal computer (PC), a UNIX workstation, a server, a mainframe computer, a personal digital assistant (PDA), smartphone, mP3 player, cellular phone, a tablet computer, a slate computer, or some combination of these. Alternatively, the user interface device 10 and the computing module device 20 may be a specialized computing device conceivable by one of skill in the art. The remaining components may include programming code, such as source code, object code or executable code, stored on a computer-readable medium that may be loaded into the memory and processed by the processor in order to perform the desired functions of the system.

Figure 2:
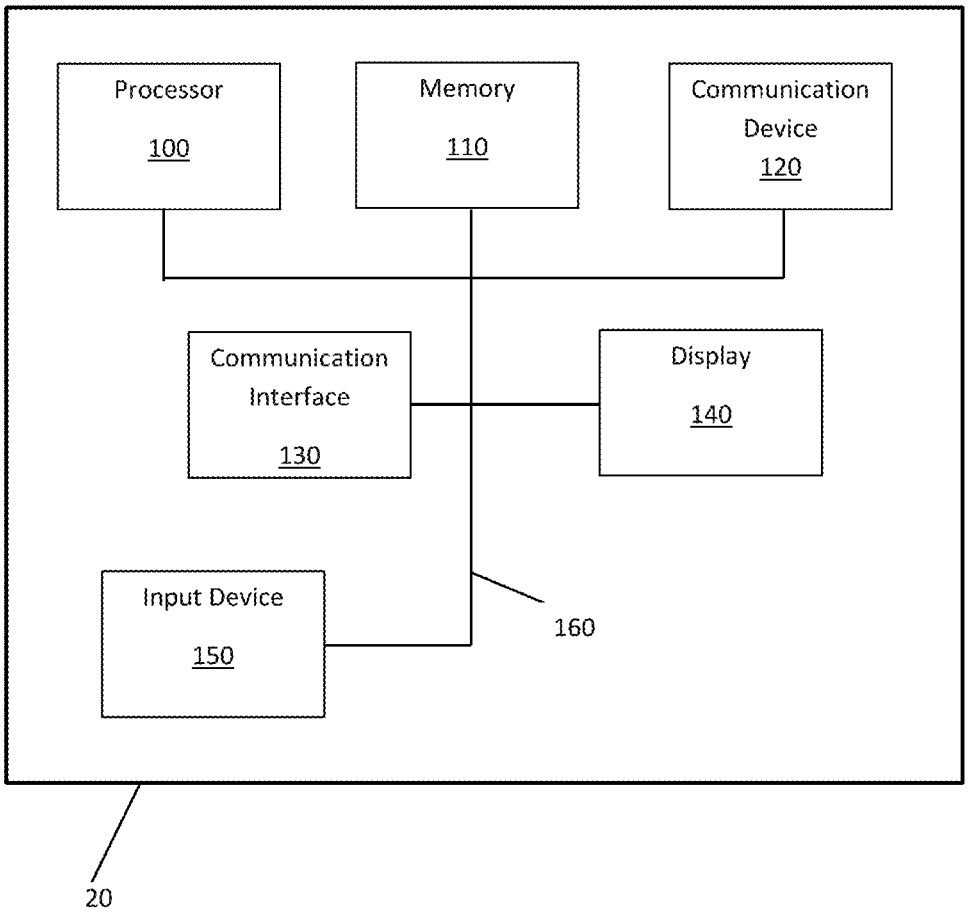
FIG. 2 illustrates a schematic diagram of a system for reproducing an acoustic scene for a listener according to an embodiment of the present invention.

The user interface device 10 and the computing module device 20 may communicate with each other over a communication network 30 via their respective communication interfaces as exemplified by element 130 of FIG. 2. Alternately, the user interface device 10 and the computing module device 20 can be connected via an information transmitting cable or other such wired connection known to or conceivable by one of skill in the art. Likewise the position tracking device 25 can also communicate over the communication network 30. Alternately, the position tracking device 25 can be connected to the user interface 10 and the computing module device 20 via an information transmitting wire or other such wired connection known to or conceivable by one of skill in the art. The communication network 30 can include any viable combination of devices and systems capable of linking computer-based systems, such as the Internet; an intranet or extranet; a local area network (LAN); a wide area network (WAN); a direct cable connection; a private network; a public network; an Ethernet-based system; a token ring; a value-added network; a telephony-based system, including, for example, T1 or E1 devices; an Asynchronous Transfer Mode (ATM) network; a wired system; a wireless system; an optical system; cellular system; satellite system; a combination of any number of distributed processing networks or systems or the like.

Referring now to FIG. 2, the user interface device 10, the computing module device 20, and the position tracking device 25 can each in certain embodiments include a processor 100, a memory 110, a communication device 120, a communication interface 130, a display 140, an input device 150, and a communication bus 160, respectively. The processor 100, may be executed in different ways for different embodiments of each of the user interface device 10 and the computing module device 20. One option is that the processor 100, is a device that can read and process data such as a program instruction stored in the memory 110, or received from an external source. Such a processor 100, may be embodied by a microcontroller. On the other hand, the processor 100 may be a collection of electrical circuitry components built to interpret certain electrical signals and perform certain tasks in response to those signals, or the processor 100, may be an integrated circuit, a field programmable gate array (FPGA), a complex programmable logic device (CPLD), a programmable logic array (PLA), an application specific integrated circuit (ASIC), or a combination thereof. Different complexities in the programming may affect the choice of type or combination of the above to comprise the processor 100.

Similar to the choice of the processor 100, the configuration of a software of the user interface device 10 and the computing module device 20 (further discussed herein) may affect the choice of memory 110, used in the user interface device 10 and the computing module device 20. Other factors may also affect the choice of memory 110, type, such as price, speed, durability, size, capacity, and reprogrammability. Thus, the memory 110, of user interface device 10 and the computing module device 20 may be, for example, volatile, non-volatile, solid state, magnetic, optical, permanent, removable, writable, rewriteable, or read-only memory. If the memory 110, is removable, examples may include a CD, DVD, or USB flash memory which may be inserted into and removed from a CD and/or DVD reader/writer (not shown), or a USB port (not shown). The CD and/or DVD reader/writer, and the USB port may be integral or peripherally connected to user interface device 10 and the remote database device 20.

In various embodiments, user interface device 10 and the computing module device 20 may be coupled to the communication network 30 (see FIG. 1) by way of the communication device 120. Positioning device 25 can also be connected by way of communication device 120, if it is included. In various embodiments the communication device 120 can incorporate any combination of devices—as well as any associated software or firmware—configured to couple processor-based systems, such as modems, network interface cards, serial buses, parallel buses, LAN or WAN interfaces, wireless or optical interfaces and the like, along with any associated transmission protocols, as may be desired or required by the design.

Working in conjunction with the communication device 120, the communication interface 130 can provide the hardware for either a wired or wireless connection. For example, the communication interface 130, may include a connector or port for an OBD, Ethernet, serial, or parallel, or other physical connection. In other embodiments, the communication interface 130, may include an antenna for sending and receiving wireless signals for various protocols, such as, Bluetooth, Wi-Fi, ZigBee, cellular telephony, and other radio frequency (RF) protocols. The user interface device 10 and the computing module device 20 can include one or more communication interfaces 130, designed for the same or different types of communication. Further, the communication interface 130, itself can be designed to handle more than one type of communication.

Additionally, an embodiment of the user interface device 10 and the computing module device 20 may communicate information to the user through the display 140, and request user input through the input device 150, by way of an interactive, menu-driven, visual display-based user interface, or graphical user interface (GUI). Alternatively, the communication may be text based only, or a combination of text and graphics. The user interface may be executed, for example, on a personal computer (PC) with a mouse and keyboard, with which the user may interactively input information using direct manipulation of the GUI. Direct manipulation may include the use of a pointing device, such as a mouse or a stylus, to select from a variety of selectable fields, including selectable menus, drop-down menus, tabs, buttons, bullets, checkboxes, text boxes, and the like. Nevertheless, various embodiments of the invention may incorporate any number of additional functional user interface schemes in place of this interface scheme, with or without the use of a mouse or buttons or keys, including for example, a trackball, a scroll wheel, a touch screen or a voice-activated system. Alternately, in order to simplify the system the display 140 and user input device 150 may be omitted or modified as known to or conceivable by one of ordinary skill in the art.

The different components of the user interface device 10, the computing module device 20, and the imaging device 25 can be linked together, to communicate with each other, by the communication bus 160. In various embodiments, any combination of the components can be connected to the communication bus 160, while other components may be separate from the user interface device 10 and the remote database device 20 and may communicate to the other components by way of the communication interface 130.

Some applications of the system and method for analyzing an image may not require that all of the elements of the system be separate pieces. For example, in some embodiments, combining the user interface device 10 and the computing module device 20 may be possible. Such an implementation may be usefully where interact connection is not readily available or portability is essential.

Figure 3:
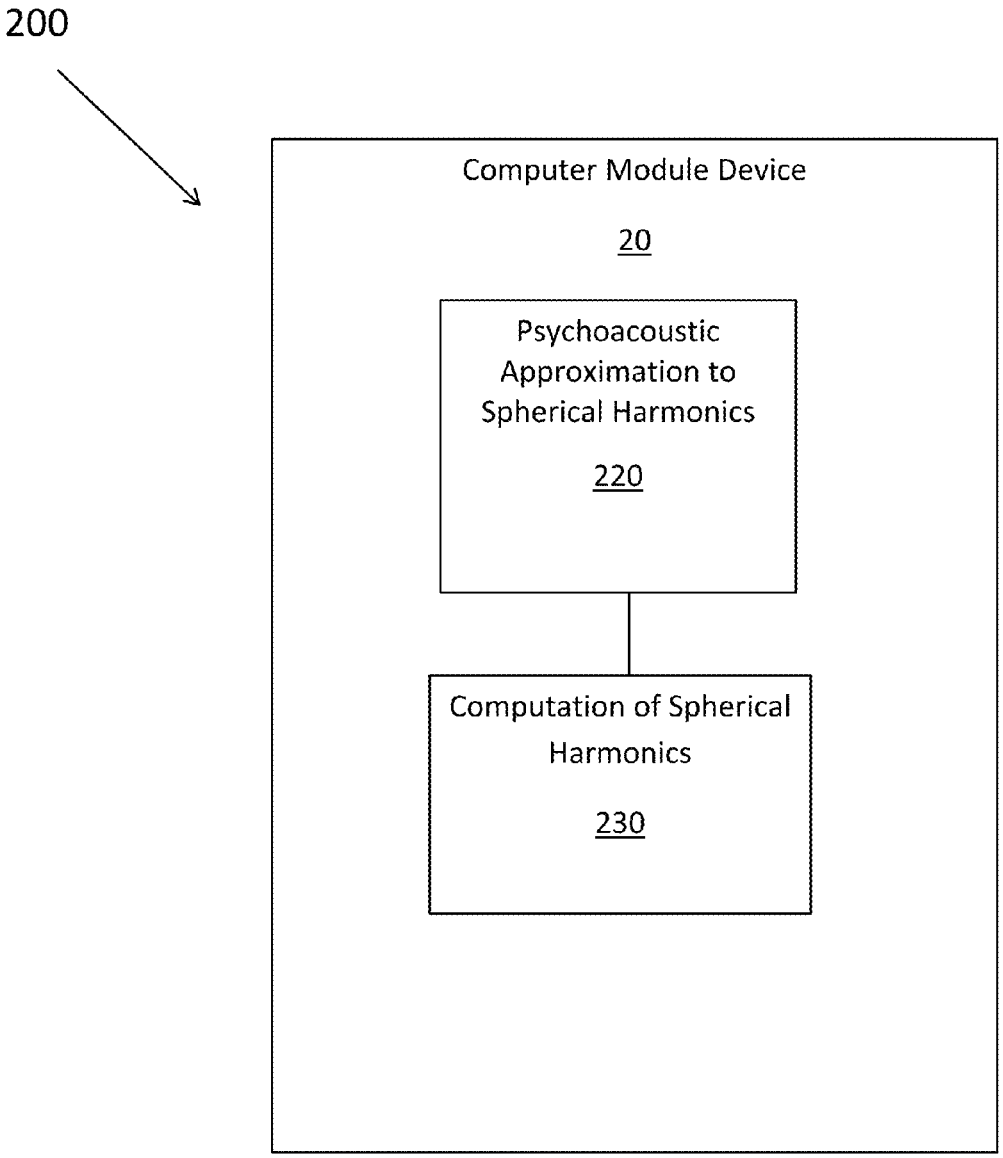
FIG. 3 illustrates a schematic diagram of a program disposed within a computer module device according to an embodiment of the present invention.

FIG. 3 illustrates a schematic diagram of a program 200 disposed within computer module device 20 according to an embodiment of the present invention. The program 200 can be disposed within the memory 110 or any other suitable location within computer module device 20. The program can include two main components for producing the binaural rendering of the acoustic scene. A first component 220 includes a psychoacoustic approximation to the spherical harmonic representation of the head-related transfer function (HRTF). A second component 230 includes a method for computing rotations of the spherical harmonics. The spherical harmonics are a set of orthonormal functions on the sphere that provide a useful basis for describing arbitrary sound fields. The decomposition is given by:

$$p(\theta,\phi,\omega)=\Sigma_{n=0}^{\infty}\Sigma_{m=-n}^{n}p_{mn}(\omega)Y_{mn}(\theta,\phi), \qquad \text{Equation 1}$$

$$p_{mn}(\omega)=\int_0^{2\pi}\int_0^{\pi}p(\theta,\phi,\omega)Y^*_{mn}(\theta,\phi)\sin\theta d\theta d\phi$$

where $p_{mn}(\omega)$ are a set of coefficients describing the sound field, $Y_{mn}(\theta, \phi)$ is the spherical harmonic of order n and degree m, and $(\bullet)^*$ is the complex conjugate. The spherical coordinate system described in Equation 1 is used in this work with azimuth angle, $\phi\epsilon[0, 2\pi]$, and zenith angle, $\theta\epsilon[0, \pi]$. The spherical harmonics are defined as $$Y_{mn}(\theta, \varphi) = \sqrt{\frac{(2n+1)}{4\pi}\frac{(n-m)!}{(n+m)!}}\,P_{mn}(\cos\theta)e^{im\varphi}$$

where $P_{mn}(\cos\theta)$ is the associated Legendre function and $i=\sqrt{-1}$ is the imaginary unit.

In any practically realizable system, the sound field must be sampled at the discrete locations of the transducers. The number of sampling points, S, needed to describe a band limited sound field up to maximum order n=N is $S\geq(N+1)^2$. However, it is not necessarily the case that the minimum bound, $S=(N+1)^2$, can be achieved without some amount of aliasing error.

In the design of a broadband spherical microphone array, such as could be used in the system described above, it is advantageous to use a spherical baffle or directional microphones to alleviate the issue of nulls in the spherical Bessel function. In this case, the pressure on the sphere due to a unit amplitude plane wave is $$p_{mn}(\omega)=b_n(kr)Y^*_{mn}(\theta_s,\phi_s)$$

where $k=2\pi f/c$ is the wavenumber, f is the frequency, c is the speed of sound, and $b_n(kr)$ is the modal gain, which is dependent on the baffle and microphone directivity. The modal gain is typically very large at low frequencies.

A beamformer, can be used in conjunction with the present invention to spatially filter a sound field by choosing a set of gains for each microphone in the array, $w(\omega)$, resulting in an output $$y(\omega) = \frac{4\pi}{S}\sum_{s=0}^{S} w_S^*(\omega)p(\theta_S, \varphi_S, \omega) =$$

$$\frac{4\pi}{S}w^H(\omega)p(\omega) = \sum_{n=0}^{N}\sum_{m=-n}^{n} w_{mn}^*(\omega)p_{mn}(\omega) = w_{mn}^H(\omega)p_{mn}(\omega)$$

$$w_{mn}(\omega) = [w_{0,0}(\omega)w_{-1,1}(\omega)w_{0,1}(\omega)w_{1,1}(\omega)\cdots w_{N,N}(\omega)]^T$$

$$p_{mn}(\omega) = [p_{0,0}(\omega)p_{-1,1}(\omega)p_{0,1}(\omega)p_{1,1}(\omega)\cdots p_{N,N}(\omega)]^T$$

where $(\bullet)^H$ is the conjugate transpose and S is the number of microphones.

The beamforming can be performed in the spatial domain, however, in accordance with the present invention it is preferable to perform the beamforming in the spherical harmonics domain. For the purposes of the calculation, it is assumed that each microphone has equal cubature weight, $$\frac{4\pi}{S},$$

and that incoming sound field is spatially band limited. These two assumptions allow the beamformer to be calculated in the spherical harmonics domain, so that the design is independent of the look direction of the listener and can be applied to arrays with different spherical sampling methods.

The robustness of a beamformer, as used in the present invention, can be quantified as the ratio of the array response in the look direction of the listener to the total array response in the presence of a spatially white noise field. This is called the white noise gain (WNG) and given by $$WNG(\omega) = \frac{|w^H(\omega)d(\omega)|^2}{w^H(\omega)w(\omega)}$$

Assuming unity gain in the look direction, this can be written in the spherical harmonics domain as:

$$WNG(\omega) = \frac{\frac{4\pi}{S}}{(B^1 w_{mn}(\omega))^H(B^{-1}w_{mn}(\omega))}$$

where $B(\omega)=\text{diag}\,[b_0(\omega)b_1(\omega)b_1(\omega)b_1(\omega)\ldots b_N(\omega)]$ is the diagonal $(N+1)^2\times(N+1)^2$ matrix of modal gains.

In the present invention, it is preferred to calculate the optimum robust beamformer coefficients, $\tilde{w}_{mn}(\omega)$, given a desired target beam pattern, $w_{mn}(\omega)$. For a single frequency this can be computed with the following convex minimization, $$\text{minimize, } \tilde{w}_{mn}\|\tilde{w}_{mn}-w_{mn}\|_2^2$$

subject to, $$\tilde{w}_{mn}^H d_{mn} = \frac{S}{4\pi}$$

and $$(B^{-1}\tilde{w}_{mn})^H(B^{-1}\tilde{w}_{mn}) \leq \frac{S}{4\pi}\delta$$

Because there is no specific look direction in an arbitrary pattern, the direction, $d_{mn}=[Y_{0,0}(\theta_1,\phi_1)Y_{-1,1}(\theta_1,\phi_1)\ldots Y_{N,N}(\theta_1,\phi_1)]^T$, is chosen as a point, or set of points, that are a desired maximum response in the target pattern. The exemplary look direction used above has the maximum response in the target pattern, $w_{mn}(\omega)^1$. The gain of the target pattern in this direction is assumed to be unity. The minimum WNG constraint is parameterized by $\delta=10^{-WNG/10}$.

Figure 4A:
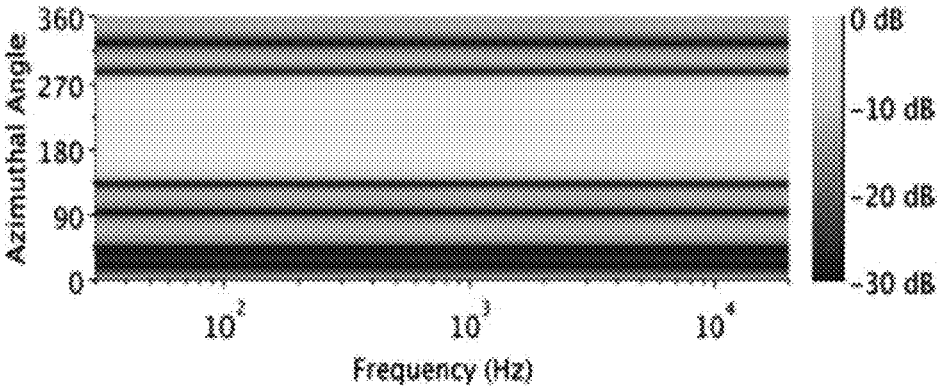
FIG. 4A illustrates a target beam pattern according to an embodiment of the present invention.
Figure 4B:
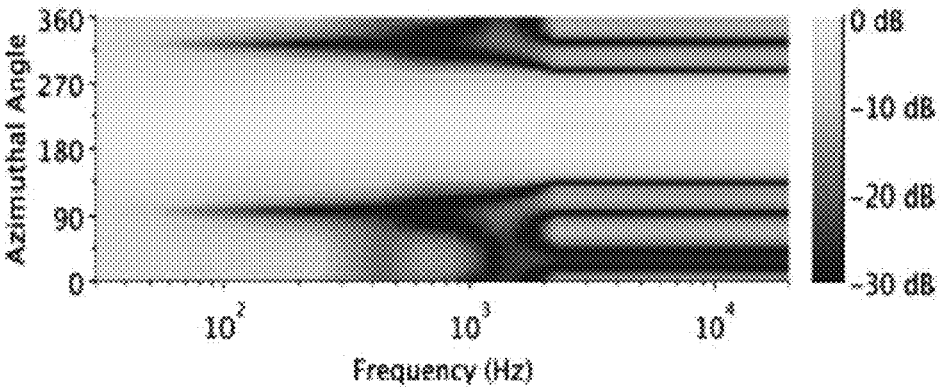
FIG. 4B illustrates a robust beam pattern according to an embodiment of the present invention.
Figure 4C:
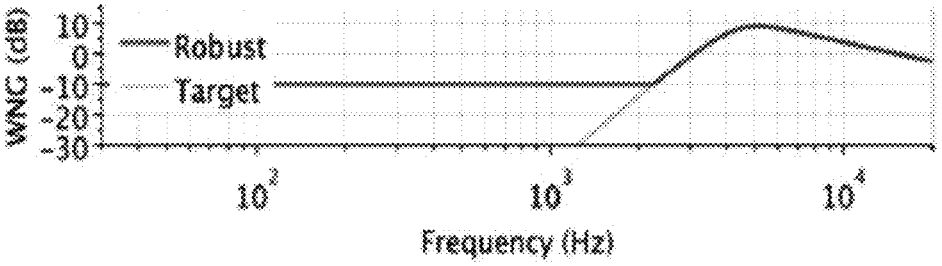
FIG. 4C illustrates WNG, with a minimum WNG of 10 dB, according to an embodiment of the present invention.

FIG. 4A shows an exemplary 4th-order, non-axisymmetric, frequency-independent target beam pattern, and FIG. 4B illustrates the frequency-dependent robust version. In this figure, only a slice through the azimuthal plane is shown so that the frequency dependence is clear. The minimization of the equation was performed in MATLAB with the free CVX package. However, any suitable mathematical software known to one of skill in the art could also be used. FIG. 4C illustrates white noise gain (WNG) with a minimum WNG of −10 dB.

The computer software for the present invention also includes a second software component 230, a general method for steering arbitrary patterns using the Wiper D-matrix. In this method the rotation coefficients, $D_{mm'}^{n}$, that represent the original field $w_{mn}$ in the rotated coordinate system, $w_{m'n}$ are calculated. These rotation coefficients only affect components within the same order of the expansion, $$w_{m'n} = \sum_{m=-n}^{n} D_{mm'}^{n} w_{mn}$$

The computation of the Wigner D-matrix coefficients, $D_{mm'}^{n}$, can be done directly or in a recursive manner. Both methods can exhibit numerical stability issues when rotating through certain angles. Instead of computing the function directly, a projection method is preferable, which is both efficient and easy to implement. By way of example, given a field that is described by a set of coefficients in the spherical harmonics domain, $p_{mn}$, we first project into the spatial domain, $$p = Yp_{mn};$$

where Y is the matrix of spherical harmonics given by $$Y = \begin{bmatrix} Y_{0,0}(\theta_1, \varphi_1) & Y_{-1,1}(\theta_1, \varphi_1) & \cdots & Y_{N,N}(\theta_1, \varphi_1) \\ Y_{0,0}(\theta_2, \varphi_2) & Y_{-1,1}(\theta_2, \varphi_2) & \cdots & Y_{N,N}(\theta_2, \varphi_2) \\ \vdots & \vdots & \ddots & \vdots \\ Y_{0,0}(\theta_S, \varphi_S) & Y_{-1,1}(\theta_S, \varphi_S) & \cdots & Y_{N,N}(\theta_S, \varphi_S) \end{bmatrix}$$

FIGS. 5A-5D illustrate an aliasing error for four spherical sampling methods plotted up to N=5. Sampling schemes in FIGS. 5A-5C all have 36 sample points. Boundaries for each order are marked. The coordinates of the sample points, ($\phi_s$; $\theta_s$), are then rotated, and a new matrix, $Y_R$, is computed to project the rotated points back into the spherical harmonics domain, $$p_r = Y_R^H Y p_{mn} = D p_{mn}$$

Figure 5A:
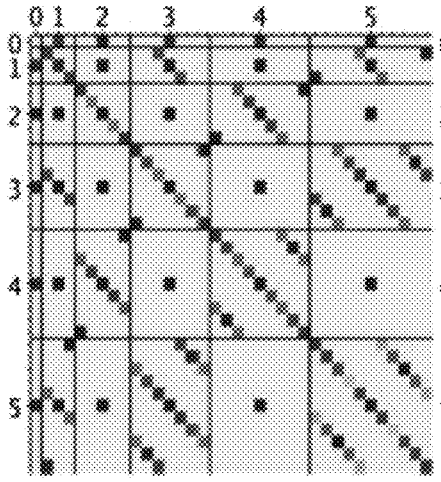
FIGS. 5A-5D illustrate an aliasing error for four spherical sampling methods plotted up to N=5, according to an embodiment of the present invention.
Figure 5B:
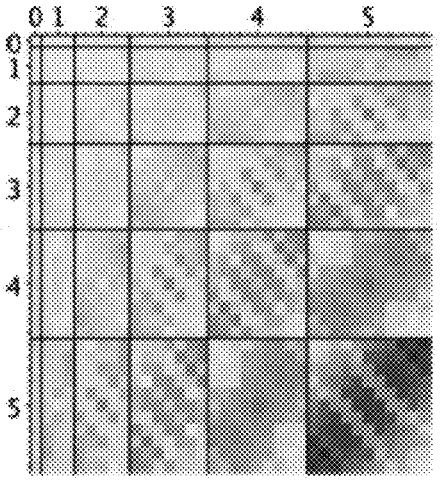
Figure 5C:
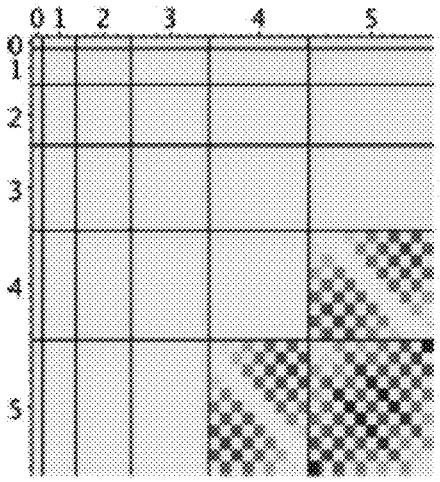
Figure 5D:
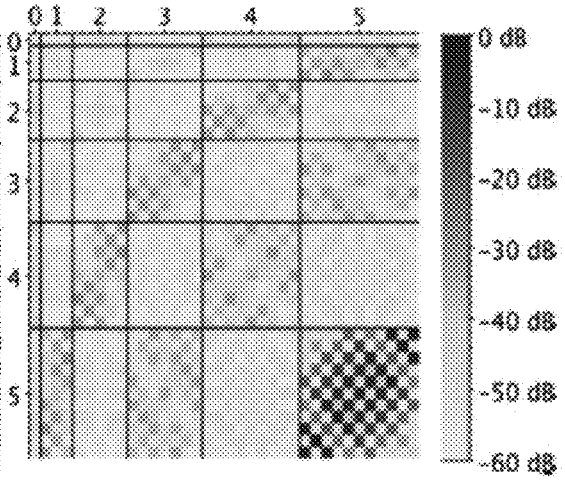

FIG. 5A illustrates an equispaced spherical sampling method, FIG. 5B illustrates a minimum potential energy spherical sampling method, FIG. 5C illustrates a spherical 8-design spherical sampling method, and FIG. 5D illustrates a truncated icosahedron sampling method that only uses 32 sample points.

A major issue with this method is that many sampling geometries exhibit strong aliasing errors that result in the distortion of the rotated beam pattern. There are two options to make sure that aliasing does not affect the rotated pattern: spatial oversampling and numerical optimization. A preferred metric to determine the aliasing contributions from each harmonic for a given spherical sampling grid is the Gram matrix, $G=Y^H Y$. The aliasing error can then be written as $$\frac{4\pi}{S} G - 1,$$

where I is the identity matrix.

The sampling theorem for a spherical surface requires $S \geq (N+1)^2$ sample points for a sound field band-limited to order N. However, in general, it is not always possible to sample the sphere at the band-limit, $S=(N+1)^2$, without spatial aliasing errors. Spherical t-designs are also preferred for spatial oversampling since they provide aliasing-free operation for all harmonics below a band limit, t=2N, as seen in FIGS. 5A-5D.

Figure 6B:
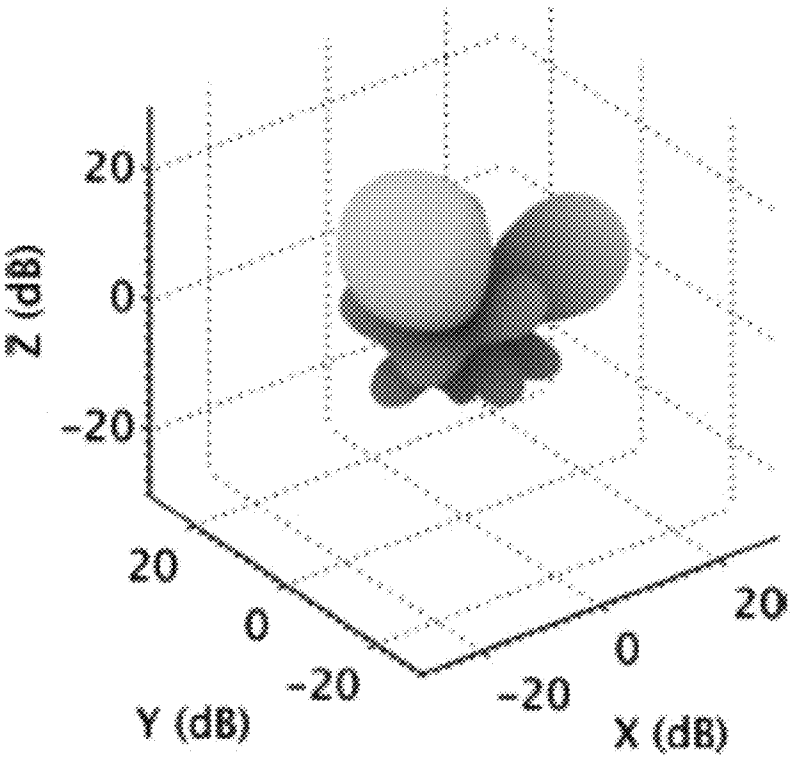
FIG. 6A illustrates exemplary original beams and FIG. 6B illustrates rotated beams using a minimum condition number spherical grid with 25 points (4th order) according to an embodiment of the present invention.
Figure 6A:
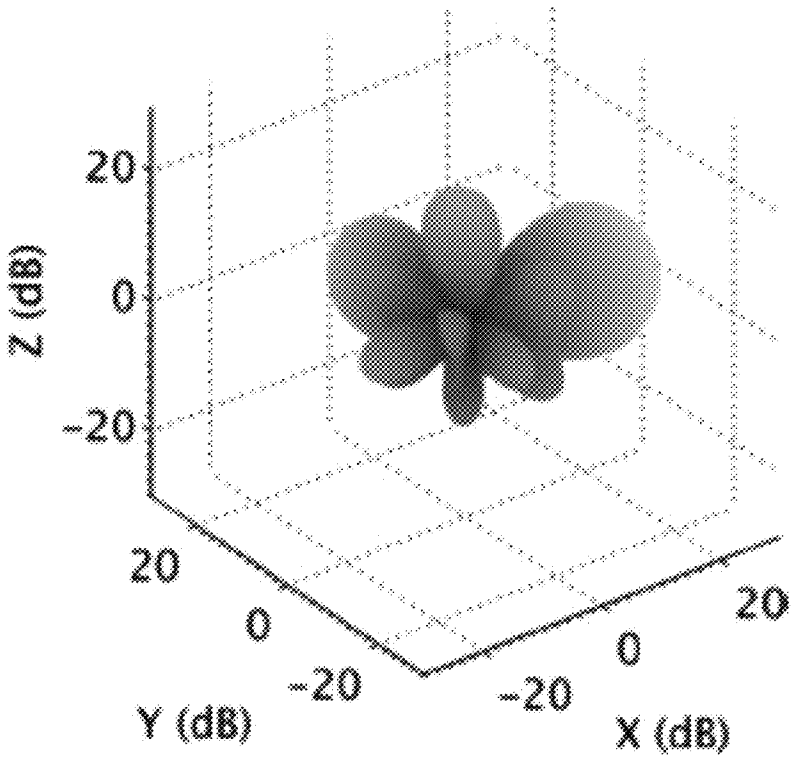

To reduce the error to negligible levels, an optimization method can be used, $$p_r = Y_R^H (Y^H)^{\dagger} p_{mn}$$

where $(\bullet)^{\dagger}$ indicates the pseudoinverse. In implementation, speedups can be achieved by noting that $(Y^H)^{\dagger}$ is independent of the rotation and D is block diagonal. Rotation of the sampling points, ($\theta_s$, $\phi_s$), should be done using quaternions to avoid issues when rotating through the poles. FIG. 6A illustrates exemplary original beams and FIG. 6B illustrates rotated beams using a minimum condition number spherical grid with 25 points (4th order).

This method allows for sampling at the band-limit with minimal error, which reduces the computational complexity. However, numerical issues can result if the condition number of the sample grid, $\kappa(Y^H Y)$, is high. By way of example, choosing the sample points that minimize the condition number of the Gram matrix can ensure that these issues do not cause irregularities in the rotated beam pattern. FIG. 6B shows an exemplary rotated beam. The original beam pattern coefficients are given by $$Y_{mn}^{*}\left(\frac{\pi}{2}, 0\right) + 0.5 Y_{mn}^{*}\left(\frac{\pi}{2}, \frac{\pi}{2}\right) + 0.25 Y_{mn}^{*}(0, 0)$$

In this example, the rotated beam pattern can be calculated exactly by inputting the rotated coordinates in $$Y_{mn}^{*}\left(\frac{\pi}{2} + \theta', \varphi'\right) + 0.5 Y_{mn}^{*}\left(\frac{\pi}{2} + \theta', \frac{\pi}{2} + \varphi'\right) + 0.25 Y_{mn}^{*}(\theta', \varphi')$$

The error between the exact and rotated beams can then be computed as $10 \log_{10} \| p_{exact} - D p_{mn} \|_2^2$. For all the rotations tested (every 1 degree in azimuth and zenith) the error was around −300 dB, showing that no distortion in the rotated pattern occurs.

The following applications are included as examples, and are not meant to be limiting. Any application of the above methods and systems known to or conceivable by one of skill in the art could also be used. When rendering a recorded spatial sound field over a loudspeaker array it is important to consider the available gain of the microphone array at low frequencies. Typical sound field rendering approaches such as mode-matching, or energy and velocity vector optimization generate a set of loudspeaker beamforms that do not take the microphone robustness into account. Furthermore, these methods and are not guaranteed to be axisymmetric, especially for irregular loudspeaker arrangements. The beam patterns generated from either approach can be used to calculate their robust versions for auralizing recorded sound fields.

The robust beamforming and steering method can also be used to design a system to render recordings from spherical microphone arrays binaurally. Here the grid of HRTF measurements at each frequency is considered as a pair of spatial filters, $h_{mn}^{l}(\omega)$ and $h_{mn}^{r}(\omega)$ The output for a single ear is then $$y(\omega) = \sum_{n=0}^{N} \sum_{m=-n}^{n} h_{mn}^{*}(\omega) p_{mn}(\omega) = h_{mn}^{H} p_{mn}$$

Figure 7A:
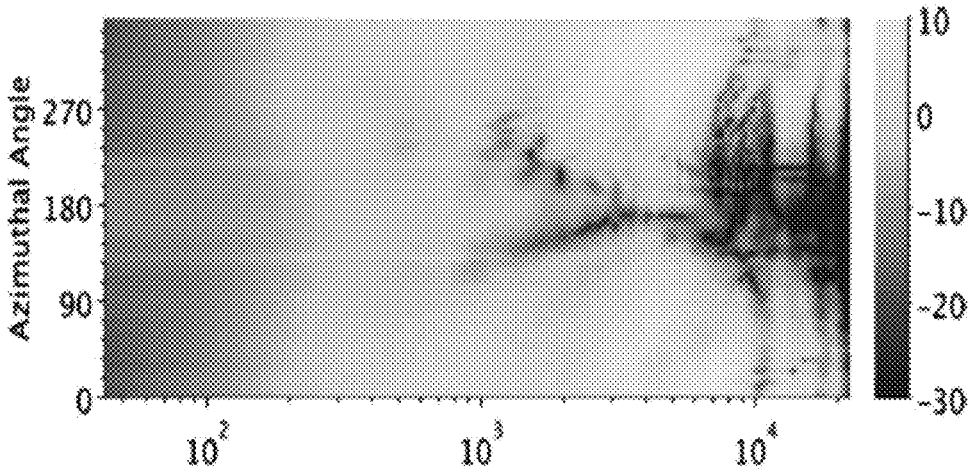
FIG. 7A illustrates a measured HRTF in the horizontal plane.
Figure 7B:
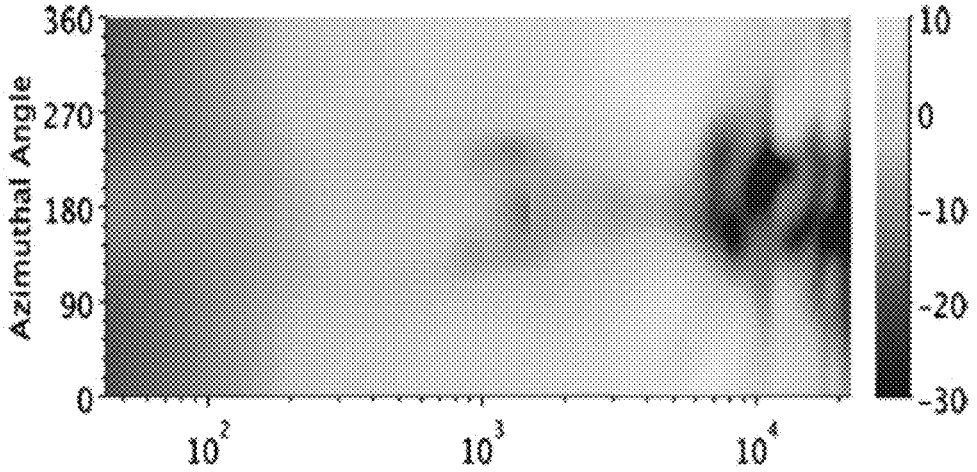
FIG. 7B illustrates the robust 4th order approximation according to an embodiment of the present invention.
Figure 8:
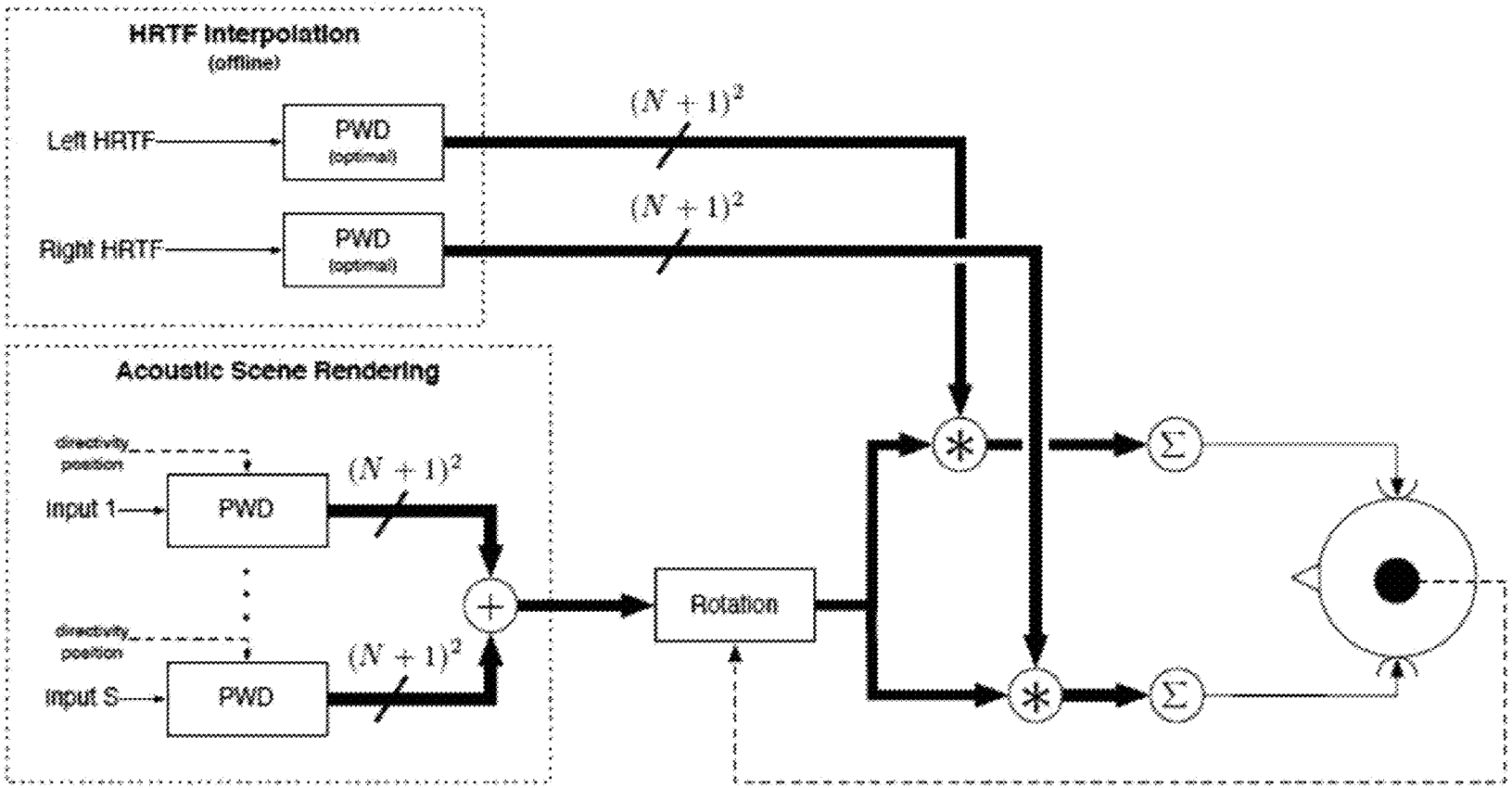
FIG. 8 illustrates a schematic diagram of an exemplary embodiment of a full binaural rendering system according to an embodiment of the present invention.

A set of preprocessing steps are performed to ensure that the perceptually relevant details can be well approximated when using a low order approximation of the sound field. The HRTF is first interpolated to an equiangular grid, then it is separated into its magnitude spectrum and a pure delay (estimated from the group delay between 500-2000 Hz), and finally the magnitudes are smoothed in frequency using 1.0 ERB filters. FIG. 8 illustrates the magnitude of the original and approximated HRTFs in the horizontal plane. It is preferable, to allow for errors in the phase above 2 kHz to ensure that the magnitudes are well approximated. This causes errors in the interaural group delay at high frequencies at the expense of making sure that the interaural level differences are correct. The robust versions of the HRTF beam patterns can be computed using hmn as the target pattern. As described above, in an exemplary prototype, steering is done with an inexpensive MEMS-based device that incorporates a 9-DOF IMU sensor. A full binaural rendering system including head-tracking is able to run on an modern laptop with a processing delay of less than 1 ms (on 44.1 kHz/32-bit data) using this method. FIG. 7A illustrates a measured HRTF in the horizontal plane, and FIG. 7B illustrates the robust 4th order approximation.

FIG. 8 illustrates an exemplary embodiment of a full binaural rendering system. This embodiment is included simply by way of example and is not intended to be considered limiting. Input sources can be either the input from a spherical microphone array, or synthesized using a given source directivity and spatial location. This scheme allows for the inclusion of both near and far sources, as well as sources with complex directional characteristics such as diffuse sources. PWDs, are the plane-wave decomposition of the input source or HRTF, as described above.

Figure 9:
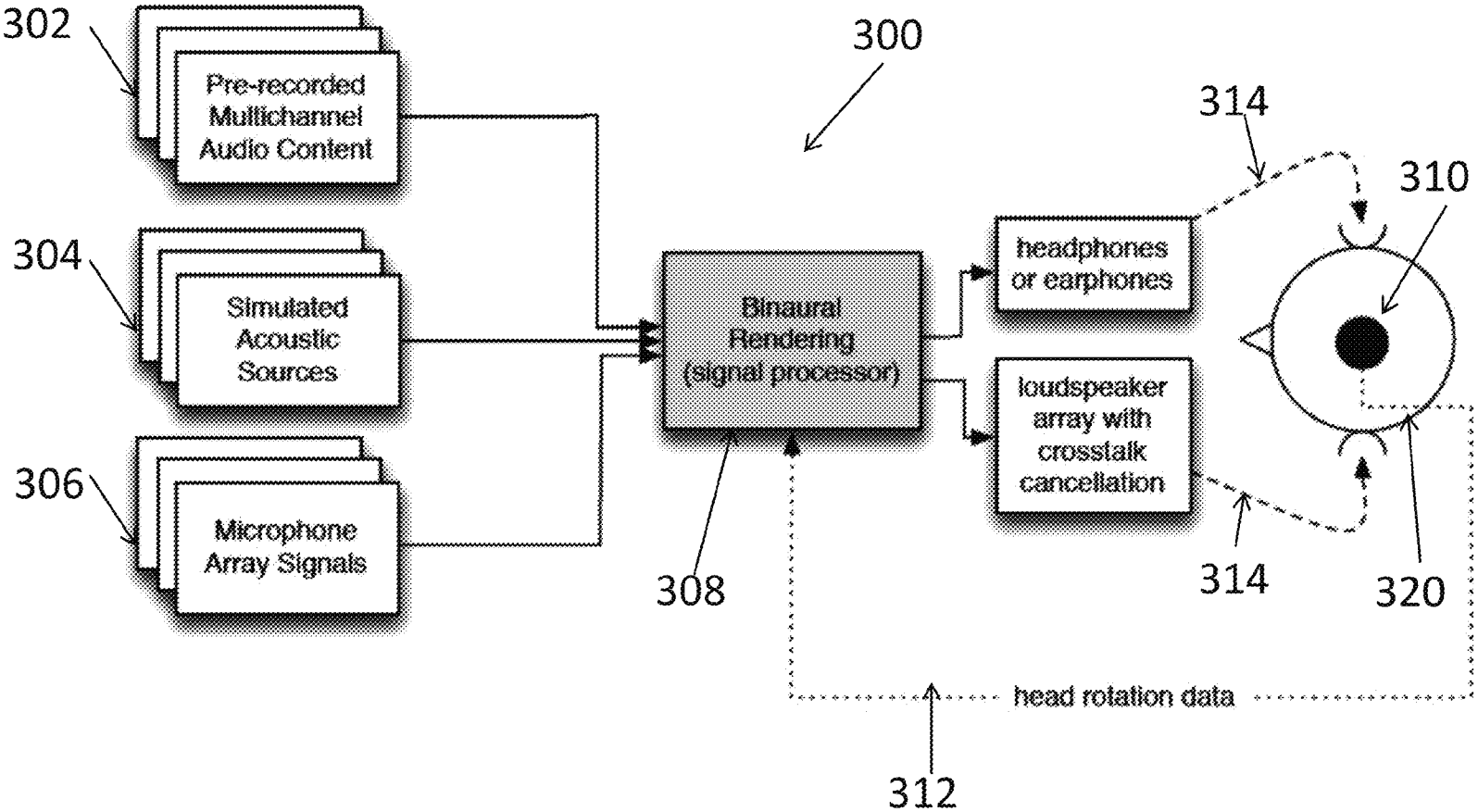
FIG. 9 illustrates a schematic diagram of an exemplary embodiment of a full binaural rendering system according to an embodiment of the present invention.

FIG. 9 illustrates a schematic diagram 300 of a binaural rendering system according to the present invention. As illustrated in FIG. 9, pre-recorded multi-channel audio content 302, simulated acoustic sources 304, and/or microphone array signals 306, can be transmitted to a device capable of binaural rendering (signal processing) 308. The device can take the form of a computing device, or any other suitable signal processing device known to or conceivable by one of skill in the art. Additionally, a head position monitoring device 310 can output a head position signal 312, such that the head position of the listener is also taken into account in the binaural rendering process of the device 308. The device 308 then transmits the binaurally processed sound data 314 to headphones 316 and/or speakers 318 for delivering the sound data 314 to a listener 320.

In current binaural renderers, the interpolation operation must be done in real-time. This severely limits the number of sources that can be synthesized, especially when source motion is desired. It also limits the complexity of the interpolation operation that can be performed. Typically, HRTFs are simply switched (resulting in undesirable transients) or a basic crossfader is used between HRTFs. In this approach, interpolation is done offline, so any type of interpolation is possible, including methods that solve complex optimization problems to determine the spherical harmonic coefficients. Furthermore, since the motion of a source is captured in the source's plane-wave decomposition, the interpolation issue does not exist for moving sources.

The addition of head tracking is also a simple operation in this context. The rotation of a spherical harmonic field was discussed above. This rotation can be applied to the left and right HRTFs individually. However, to eliminate a rotation, it can instead be applied to the acoustic scene, where the scene then rotates in the opposite direction of the head.

Head tracking binaural systems have traditionally been limited to laboratory settings due to the need for expensive electromagnetic-based tracking systems such as the Polhemus FastTrack. However, recent advances in MEMS technology have made it possible to purchase inexpensive 9 degree-of-freedom sensors with similar performance at a fraction of the price. Alternatively, due to the wide proliferation of computing devices with front-facing cameras, a computer-vision based head-tracking approach is also feasible for this type of system.

A head tracking system in this work uses a PNI SpacePoint Fusion 9DOF MEMS sensor. A Kalman filter is used to fuse the data from the 3-axis accelerometer, 3-axis gyroscope, and 3-axis magnetometer and provide a small amount of smoothing. It should be noted that such audio signals can be generated in a virtual world such as gamming to artificially generate images in any direction, based on the user's head position in orientation to the virtual world.

Figure 10:
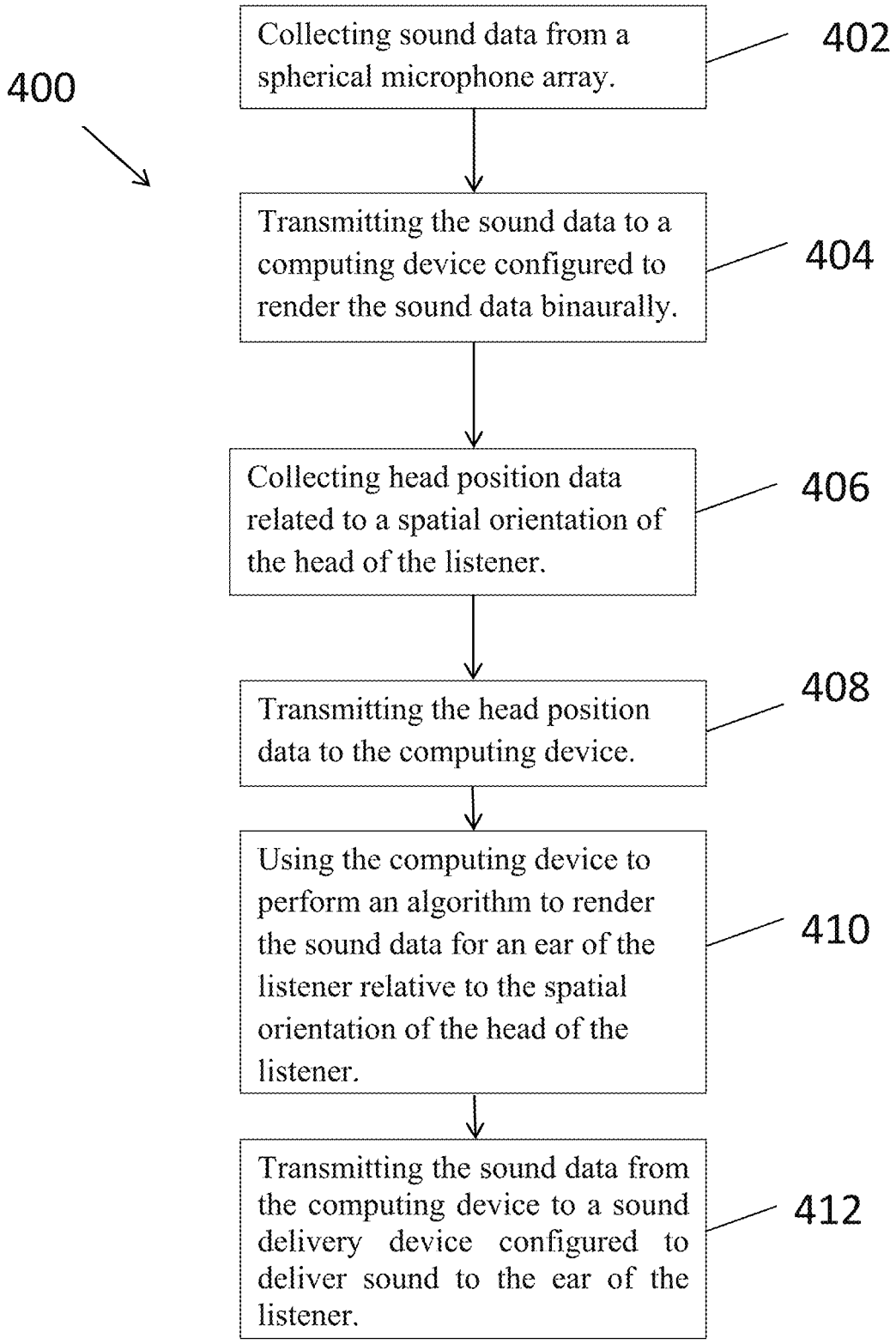
FIG. 10 illustrates a flow diagram of a method of providing binaually rendered sound to a listener according to an embodiment of the present invention.

FIG. 10 illustrates a method 400 of providing binaually rendered sound to a listener. The method 400 includes a step 402 of collecting sound data from a spherical microphone array. Step 404 can include transmitting the sound data to a computing device configured to render the sound data binaurally, and step 406 can include collecting head position data related to a spatial orientation of the head of the listener. Step 408 includes transmitting the head position data to the computing device, and step 410 includes using the computing device to perform an algorithm to render the sound data for an ear of the listener relative to the spatial orientation of the head of the listener. Additionally, step 412 includes transmitting the sound data from the computing device to a sound delivery device configured to deliver sound to the ear of the listener.

The method 400 can also include an algorithm executed by the computing device being defined as:

$$y(\omega) = \sum_{n=0}^{N} \sum_{m=-n}^{n} h_{mn}^{*}(\omega) p_{mn}(\omega) = h_{mn}^{H} p_{mn}.$$

The sound data can be preprocessed, which can include the steps of: interpolating an HRTF into an appropriate spherical sampling grid; separating the HRTF into a magnitude spectrum and a pure delay; and smoothing a magnitude of the HRTF in frequency. Collecting head position data is done with at least one of accelerometer, gyroscope, three-axis compass, and depth camera.

Finally, it should be noted that this technique is not limited to headphone playback. As mentioned earlier, binaural scenes can be played back over loudspeakers using crosstalk cancellation filters. In this type of situation it would be preferable to use a vision-based head tracking system, such as a three-dimensional depth camera or any other vision-based head tracking system known to one of skill in the art. Furthermore, as more sophisticated acoustic scene analysis and computer listening devices are created, the desire for binaural processing methods that allow for rotations will become necessary. A spherical microphone array along with this binaural processing method could function as a simple preprocessing model to extract the left and right ear signals while allowing for the computerized steering of the look direction in such a system.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. It should also be noted that the present invention can be used for a number of different applications known to or conceivable by one of skill in the art, such as, but not limited to gaming, education, remote surveillance, military training, and entertainment.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A system for reproducing an acoustic scene for a listener comprising:

a computing device configured to process a sound recording of the acoustic scene using a spherical harmonic representation of a head-related transfer function, wherein the head-related transfer function is interpolated into a spherical sampling grid offline and not in real-time, and a beamformer equation, wherein both the head-related transfer function and the beamformer equation are combined to produce a binaurally rendered acoustic scene for the listener, wherein the binaurally rendered acoustic scene is produced for any head position of the listener before the head position of the listener is known, and rotation is applied to the acoustic scene, such that the scene is configured to rotate in the opposite direction of a head of the user, and wherein motion of a sound source is captured in the sound source's plane-wave decomposition;

a position sensor configured to collect motion and position data for a head of the user and also configured to transmit said motion and position data to the computing device;

a sound delivery device configured to receive the binaurally rendered acoustic scene from the computing device and configured to transmit the binaurally rendered acoustic scene to a left ear and a right ear of the listener; and wherein the computing device is further configured to utilize the motion and position data from the inertial motion sensor in order to process the sound recording of the acoustic scene with respect to the motion and position of the user's head.

2. The system of claim 1 further comprising a sound collection device configured to collect an entire acoustic field in a predetermined spatial subspace.

3. The system of claim 2 wherein the sound collection device further comprises one selected from the group consisting of a microphone array, pre-mixed content, or software synthesizer.

4. The system of claim 1 wherein the sound delivery device comprises one selected from the group consisting of headphones, earbuds, and speakers.

5. The system of claim 1 wherein the position sensor comprises at least one of an accelerometer, gyroscope, three-axis compass, camera, and depth camera.

6. The system of claim 1 wherein the computing device is programmed to project head related impulse responses (HRIRs) and the sound recording into the spherical harmonic subspace.

7. The system of claim 6 further comprising the computing device being programmed to perform a psychoacoustic approximation, such that rendering of the acoustic scene is done directly from the spherical harmonic subspace.

8. The system of claim 6 further comprising the computing device being programmed to compute rotations of a sphere in the spherical harmonic subspace by generating a set of sample point on the sphere and calculating the Wigner-D rotation matrix via a method of projecting onto these sample points, rotating the points, and then projecting back to the spherical harmonics.

9. The system of claim 8 further comprising the computing device being programmed to calculate rotation of the sphere using quaternions.

10. A method for reproducing an acoustic scene for a listener comprising:

collecting sound data from a spherical microphone array;

transmitting the sound data to a computing device configured to render the sound data binaurally;

collecting head position data related to a spatial orientation of the head of the listener;

transmitting the head position data to the computing device;

using the computing device to perform an algorithm to render the sound data for an ear of the listener relative to the spatial orientation of the head of the listener using a spherical harmonic representation of a head-related transfer function and a beamformer equation, wherein the head-related transfer function is interpolated into a spherical sampling grid offline and not in real-time, wherein both the head-related transfer function and the beamformer equation are combined to produce a binaurally rendered scene for the listener, wherein the binaurally rendered acoustic scene is produced for any head position of the listener before the head position of the listener is known, and wherein rotation is applied to the acoustic scene, such that the scene is configured to rotate in the opposite direction of a head of the user, wherein motion of a sound source is captured in the sound source's plane-wave decomposition; and transmitting the sound data from the computing device to a sound delivery device configured to deliver sound to the ear of the listener.

11. The method of claim 10 wherein the algorithm executed by the computing device is:

$$y(\omega) = \sum_{n=0}^{N} \sum_{m=-n}^{n} h_{mn}^{*}(\omega) p_{mn}(\omega) = h_{mn}^{H} p_{mn}.$$

12. The method of claim 10 further comprising preprocessing the sound data.

13. The method of claim 12 wherein preprocessing further comprises:

interpolating an HRTF into an appropriate spherical sampling grid;

separating the HRTF into a magnitude spectrum and a pure delay; and smoothing a magnitude of the HRTF in frequency.

14. The method of claim 10 wherein collecting head position data is done with at least one of accelerometer, gyroscope, three-axis compass, camera, and depth camera.

15. A device for transmitting a binaurally rendered acoustic scene to a left ear and a right ear of a listener comprising:

a sound delivery component for transmitting sound to the left ear and to the right ear of the listener;

a position sensing device configured to collect motion and position data for a head of the user;

wherein the device for transmitting a binaurally rendered acoustic scene is further configured to transmit head position data to a computing device and wherein the device for transmitting a binaurally rendered acoustic scene is further configured to receive sound data for transmitting sound to the left ear and to the right ear of the listener from the computing device, wherein the sound data is rendered relative to the head position data, wherein both a head-related transfer function and a beamformer equation are combined to produce a binaurally rendered scene for the listener, wherein the head-related transfer function is interpolated into a spherical sampling grid offline and not in real-time, wherein the binaurally rendered acoustic scene is produced for any head position of the listener, wherein motion of a sound source is captured in the sound source's plane-wave decomposition.

16. The device of claim 15 wherein the sound delivery component comprises one selected from the group consisting of headphones, earbuds, and speakers.

17. The device of claim 15 wherein the position sensing device comprises at least one of an accelerometer, gyroscope, three-axis compass, camera, and depth camera.

18. The device of claim 15 wherein the computing device is programmed to project head related impulse responses (HRIRs) and the sound recording into the spherical harmonic subspace.

19. The device of claim 18 further comprising the computing device being programmed to perform a psychoacoustic approximation, such that rendering of the acoustic scene is done directly from the spherical harmonic subspace.

20. The device of claim 18 further comprising the computing device being programmed to compute rotations of a sphere in the spherical harmonic subspace by generating a set of sample point on the sphere and minimizing a condition number of a Gram matrix of the sphere.

* * * * *